US009554211B2

(12) United States Patent
Boehlke

(10) Patent No.: US 9,554,211 B2
(45) Date of Patent: Jan. 24, 2017

(54) WIRELESS SPEAKER UNIT

(71) Applicant: Summit Semiconductor LLC, Hillsboro, OR (US)

(72) Inventor: Kenneth A. Boehlke, Portland, OR (US)

(73) Assignee: Summit Semiconductor LLC, Beaverton, OR (US)

( * ) Notice: Subject to any disclaimer, the term of this patent is extended or adjusted under 35 U.S.C. 154(b) by 239 days.

(21) Appl. No.: 14/566,108

(22) Filed: Dec. 10, 2014

(65) Prior Publication Data

US 2015/0195651 A1 Jul. 9, 2015

Related U.S. Application Data

(60) Provisional application No. 61/923,376, filed on Jan. 3, 2014.

(51) Int. Cl.

| | |
|---|---|
| ***H04R 5/02*** | (2006.01) |
| ***H04R 5/00*** | (2006.01) |
| ***H04R 5/04*** | (2006.01) |
| *H04R 27/00* | (2006.01) |

(52) U.S. Cl.
CPC *H04R 5/00* (2013.01); *H04R 5/04* (2013.01); *H04R 5/02* (2013.01); *H04R 27/00* (2013.01); *H04R 2420/07* (2013.01)

(58) Field of Classification Search
CPC ..... H04R 5/00; H04R 5/02; H04R 5/04; H04R 2420/07; H04R 27/00
USPC ..... 381/307
See application file for complete search history.

(56) References Cited

U.S. PATENT DOCUMENTS

| | | | | |
|---|---|---|---|---|
| 5,184,310 | A | 2/1993 | Takenouchi | |
| 5,568,044 | A | 10/1996 | Bittner | |
| 6,344,811 | B1 | 2/2002 | Melanson | |
| 6,621,256 | B2 | 9/2003 | Muratov et al. | |
| 7,535,183 | B2 | 5/2009 | Gurr | |
| 7,786,714 | B2 | 8/2010 | Bacchi et al. | |
| 8,199,941 | B2 | 6/2012 | Hudson et al. | |
| 8,570,015 | B2 | 10/2013 | Lima et al. | |
| 2002/0158613 | A1 | 10/2002 | Muratov et al. | |
| 2003/0218894 | A1 | 11/2003 | Utsunomiya | |
| 2004/0141341 | A1 | 7/2004 | Higashitani et al. | |
| 2011/0116653 | A1 | 5/2011 | Schuurmans | |
| 2012/0019224 | A1 | 1/2012 | Lima et al. | |
| 2012/0256604 | A1 | 10/2012 | Tang | |
| 2013/0251178 | A1* | 9/2013 | Yoon | H04R 3/12 381/307 |

FOREIGN PATENT DOCUMENTS

| | | | |
|---|---|---|---|
| EP | 1239574 | B1 | 5/2007 |

OTHER PUBLICATIONS

WiSA LLC, Wireless Speaker & Audio, www.wisaassociation.org, Dec. 2011, 7 pgs.

* cited by examiner

*Primary Examiner* — Paul S Kim
(74) *Attorney, Agent, or Firm* — Chernoff, Vilhauer, McClung & Stenzel, LLP

(57) ABSTRACT

A wireless speaker unit includes a radio transceiver oscillator which provides timing signals to a pulse width modulator and to a sample rate controller that provides a variable oversampling signal to a delta sigma modulator. The variable oversampling signal determined by a sampling rate of the digital audio signal.

15 Claims, 4 Drawing Sheets

WIRELESS SPEAKER UNIT

CROSS-REFERENCE TO RELATED APPLICATIONS

This application claims the benefit of U.S. Provisional Application No. 61/923,376, filed Jan. 3, 2014.

BACKGROUND OF THE INVENTION

The present invention relates to high quality audio and, more particularly, a wireless speaker system for reproducing high quality multichannel audio.

A home theater system typically comprises one or more signal sources, such as a digital versatile disc (DVD) player, a BLU-ray™ disc (BD) player or broadcast receiver; a display unit; an audio video control receiver (AVR); and multiple speaker units. An audio processor which may be integrated in the AVR or located elsewhere in the system converts analog or digital signals received from the signal source to an appropriate form for transmission to the speaker units. A home theater system may employ wired connections between the audio processor and the speaker units in which analog signals, which may be converted by an audio processor from digital data received from the signal source, are commonly amplified by the AVR and transmitted to the speaker units. However, it can be difficult or impractical to route wires to remote speakers once a room has been finished and the wires can be unsightly and subject to damage when exposed along a wall or routed under a carpet. For this reason, home theater systems often utilize wireless signal paths between the AVR and the speaker units. Digital data, including converted analog signals from a signal source, are packetized and multiplexed into a transport data stream by the audio processor of the AVR. An AVR transceiver modulates a carrier with the transport data stream and transmits the modulated carrier to a transceiver located in each wireless speaker unit making up the system. In the speaker unit, the digital audio data is separated from the carrier and converted to an analog signal or a succession of pulses which are amplified and transmitted to the speaker.

Surround sound, a technique for enhancing the perception of the spatial origin of sound by adding audio channels which are selectively output by speakers that, at least partially, encircle the listener is a common feature of home theater systems. Six channel surround sound audio; exemplified by Dolby Digital®, Dolby Pro Logic II™, DTS™, and SDDS™ surround sound audio; is the standard surround sound audio component of digital broadcast and music and the most common surround sound system for both commercial and home theaters. Six channel surround sound audio systems, known as 5.1 ("five point one") surround sound systems, utilize five full bandwidth channels; a front left channel, a front right channel, a center channel, and, respective, left and right surround channels; each reproduced by a corresponding speaker. In addition, the 5.1 surround sound system includes one low-frequency effects channel, the point one (0.1) channel, which is reproduced by a subwoofer. Increasingly, manufacturers of home theater systems are adapting an eight channel (7.1) surround audio system with a standard front or center speaker, a subwoofer and four surround speakers. Whereas a 5.1 surround sound system combines both surround and rear channel audio into two channels, a 7.1 surround system splits the surround and rear channel audio into four distinct signals with sound effects directed to left and right channels through speakers to the sides of the listener plus two rear surround channels to the listener's left-rear and right-rear. High end home theater systems, such as 11.1 surround sound systems, with even greater numbers of speakers are contemplated. While wireless digital communication between the AVR and the speakers eliminates problems relating to routing wires, it typically increases the cost of the system because each remote speaker unit must have its own power supply, transceiver to receive the radio frequency signal from the AVR; digital-to-analog converter (DAC) to accurately convert the digital audio signals transmitted by the AVR to an analog signal or a high frequency sequence of pulses and, to provide a signal to drive the speaker, an amplifier to amplify the analog signal or pulses.

What is desired therefore, is an economical wireless speaker unit which produces high quality audio.

DETAILED DESCRIPTION OF PREFERRED EMBODIMENTS

Specific sampling and/or oversampling rates, operating frequencies and other operating parameters referred to in describing preferred embodiments are for illustration purposes only and not intended to limit the scope of the invention. Those skilled in the art will recognize that the invention is not limited by the specific examples disclosed herein and can be applied to other circuits and methods having operating parameters different that those disclosed.

Figure 1:
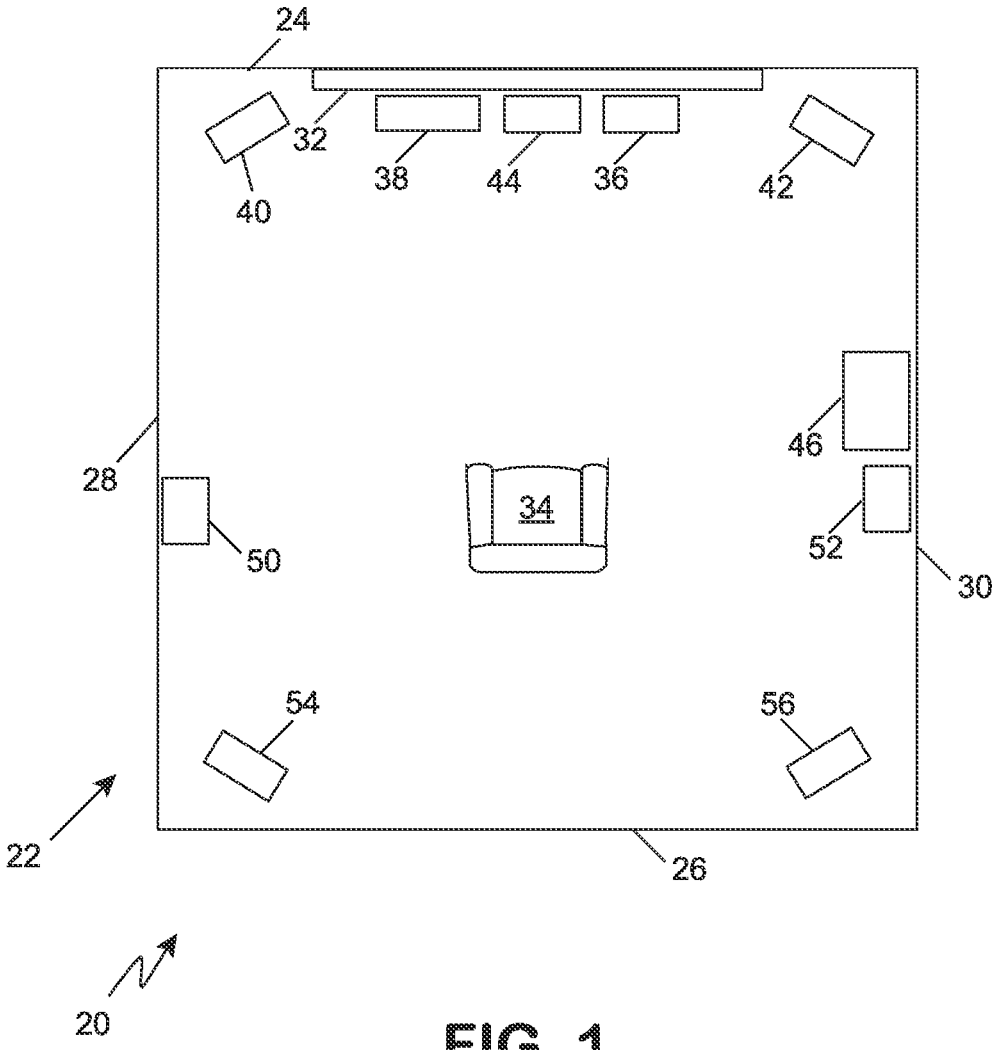
FIG. 1 is a plan view of a room and an exemplary 7.1 home theater system installation.

Referring in detail to the drawings where similar parts are identified by like reference numerals, and, more particularly to FIG. 1, a surround sound home theater system 20 is commonly installed in a room 22 having front 24, rear 26, left 28 and right 30 walls, with a display unit 32 against the front wall and plural speaker units located adjacent to the walls and, at least partially, encircling a substantially central listening location or sweet spot 34. In addition to the speaker units a home theater system 20 typically comprises one or more signal sources 36, such as, a satellite receiver, a cable TV decoder, a digital versatile disc (DVD) player and/or a Blu-ray™ disc (BD) player; and an audio video control receiver (AVR) 38, which may be a stand-alone unit or which may be integrated with the display 32, a signal source 36 or elsewhere in the system.

The number and arrangement of speaker units in a home theater system varies. A 5.1 ("five point one") surround sound system reproduces the standard surround sound audio component of digital broadcast and music and is the most common layout for both commercial and home theaters. Dolby Digital®, Dolby Pro Logic II™, DTS™, and SDDS™ surround sound are examples of surround sound that is reproduced by five point one (5.1) surround sound audio systems. A 5.1 surround sound audio system has five full bandwidth channels respectively reproduced by a front left 40, a front right 42, a (front) center 44, and left and right speaker units and one low-frequency effects channel reproduced by a subwoofer 46. While 5.1 surround sound systems are the most common, increasingly manufacturers of higher end home theater systems are adopting 7.1 surround sound which, in addition to a standard subwoofer 46 and (front) center 44, front left 40 and front right 42 surround speaker units, splits surround and rear channel audio into four distinct signals with sound effects directed to left and right channels reproduced by speaker units to the left 50 and right 52 of the central listening location or sweet spot 34 plus two rear surround channels to be reproduced by speakers units to the left rear 54 and right rear 56 of the sweet spot. Systems with even greater numbers of speakers, for example 11 surround speakers and one or even two subwoofers are contemplated.

Figure 2:
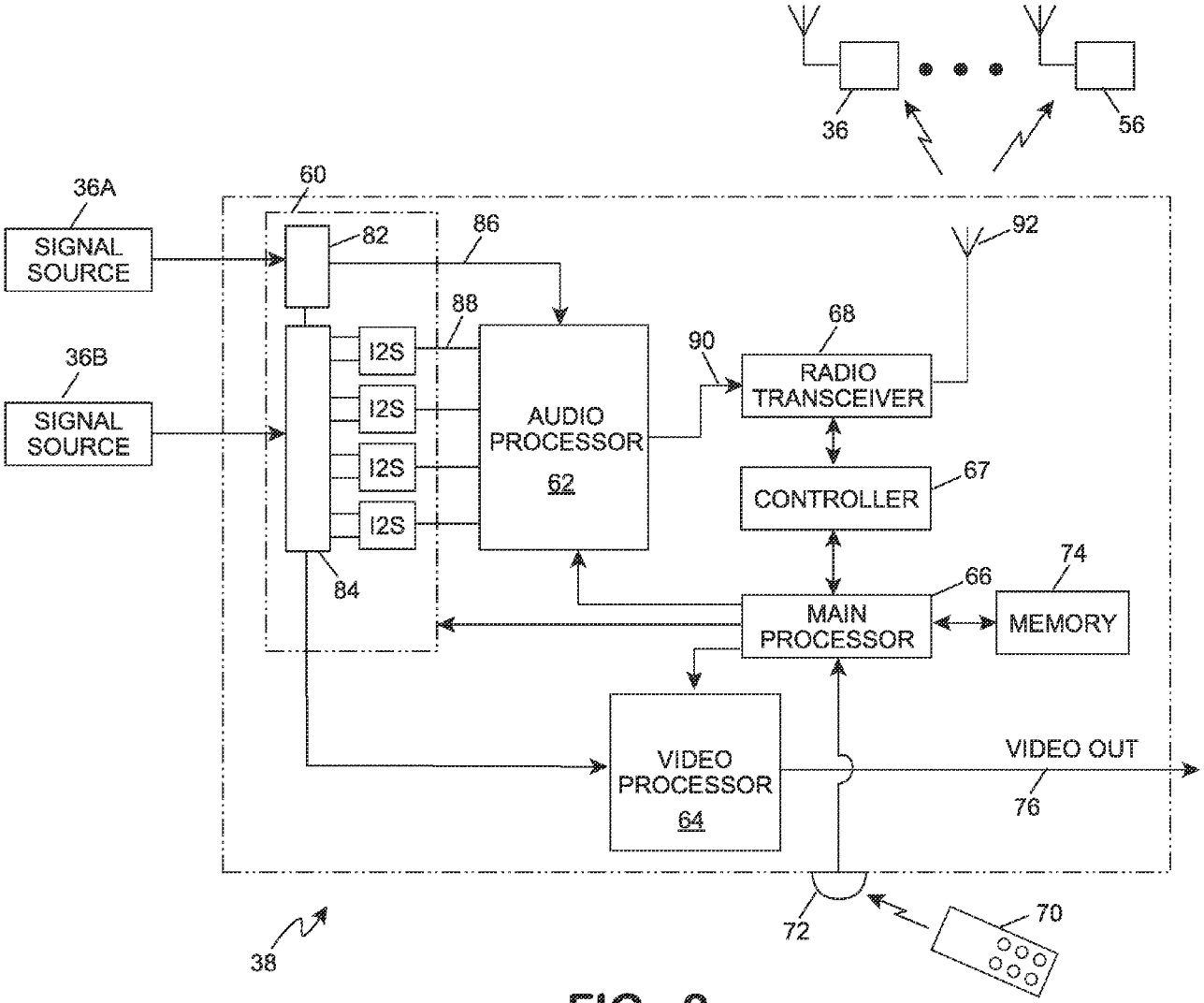
FIG. 2 is a block diagram of an exemplary audio video receiver (AVR) of a home theater system.

Referring to also FIG. 2, the AVR 38 of the exemplary home theater system 20 comprises, generally, an interface 60 for audio and/or video signals transmitted by one or more signal sources 36A, 36B, an audio processor 62 and a video processor 64. The exemplary AVR 38 is controlled by a main processor 66 which is communicatively connected to the audio processor 62, the video processor 64 and a controller 67 for a radio transceiver 68. Typically, a user interacts with the home theater system with a hand-held remote control unit 70 that transmits user commands to an infrared (IR) receiver 72 of the AVR. The IR receiver 72 is in communication with the main processor 66 which responds to user commands according to instructions stored in a non-volatile memory 74. The video processor 64 is connected to the interface 60 and arranged to receive video signals in one or more formats from the interface. The video processor 64 decodes the video signals and transmits the video output signal 76 to the display 32 for rendering.

The audio processor 62 is also connected to the interface 60 to receive audio signals transmitted to the interface by the signal source(s). The interface 60 may comprise plural interface portions each arranged to receive audio signals in a respective format from the ones of signal sources. For examples, the audio interface may include an audio coder/decoder (codec) 82 comprising an analog-to-digital converter (ADC) for receiving and converting analog audio signals from a signal source 36A to digital signals for processing by the audio processor. The interface 60 also includes a portion 84 arranged to receive digital signals from a signal source 36B, for example, a DVD player, a BD player and/or a high definition media interface (HDMI). Digital signals from various signal sources have sampling rates that vary within each type of signal source as well as between types of signal sources.

The interface 60 is connected to the audio processor 62 by one or more busses 86, 88 which conduct bus signals, for example, Integrated Interchip Sound ($I^2S$) serial bus signals to the audio processor. The audio processor 62 separates the bus signals into their components and assigns each of the resulting digital audio signals and/or other digital signals related to operation of the system, such as metadata, to respective slots in a multiplexed serial transport signal 90. In a home theater system with wireless speaker units, such as the exemplary home theater system 20, the transport signal 90 is communicated to the radio transceiver 68 which modulates a carrier with the transport signal and transmits the modulated carrier signal to the wireless speaker units 36, 40-46, 50-56 via an antenna 92.

Figure 3:
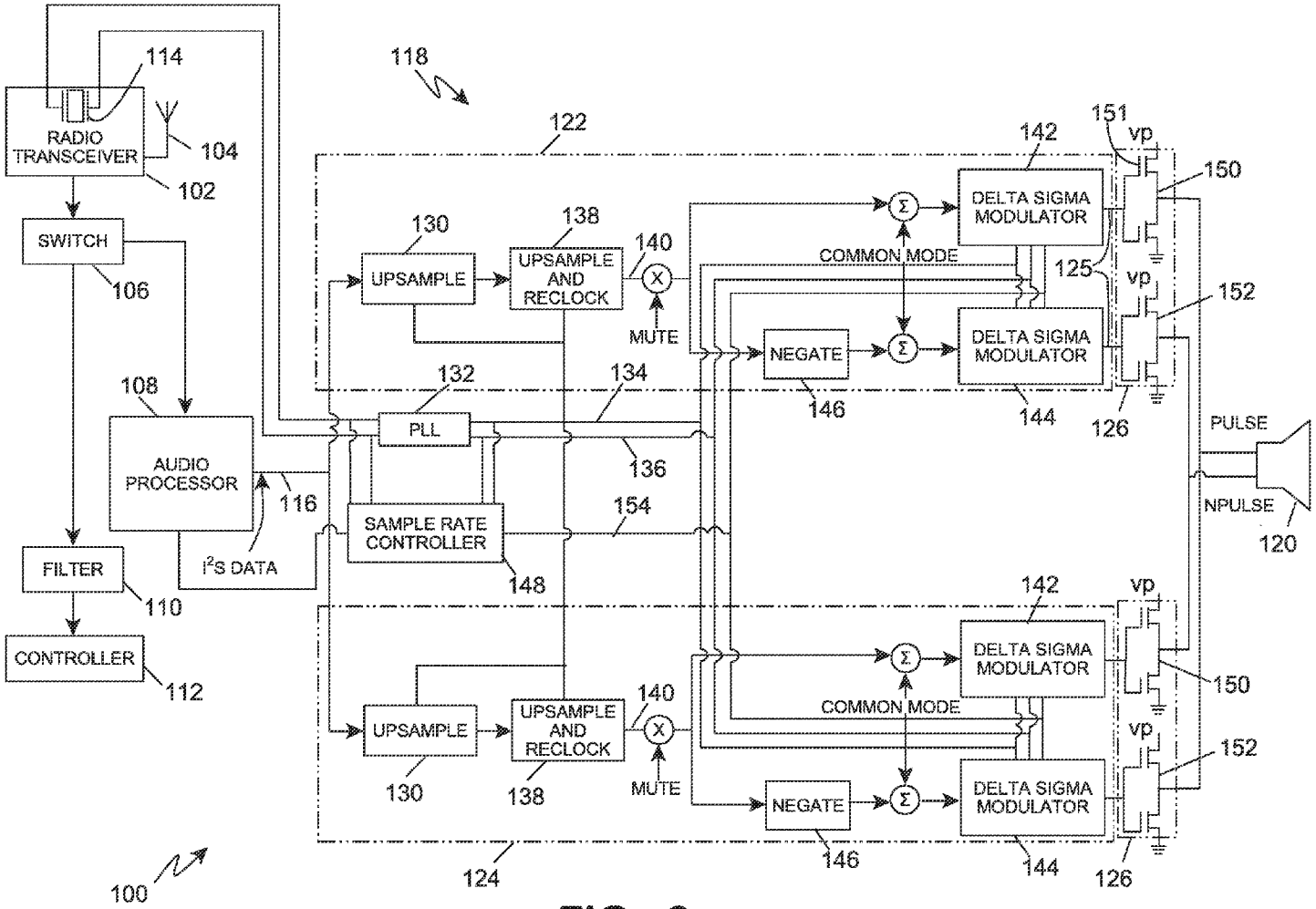
FIG. 3 is a block diagram of an exemplary speaker unit of a home theater system.

Referring also to FIG. 3, a typical speaker unit 100 of the exemplary wireless home theater system 20, for example speaker unit 36, includes electronic circuitry connected to a source of operating current. The electronic circuitry of the speaker unit includes a radio transceiver 102 connected to an antenna 104 for transmitting signals and for receiving transmitted signals including the modulated carrier signal transmitted by the AVR. The radio transceiver separates the transport signal from the carrier and transmits the transport signal to a switch 106 which directs the transport signal to either the speaker unit's audio processor 108 or, via a message filter 110, to a controller 112 which controls the operation of the speaker unit. A crystal oscillator 114, in which the mechanical resonance of a vibrating piezoelectric crystal outputs an alternating electrical signal, provides a stable clock signal for the digital radio transceiver 102. Typically, the frequency of the transceiver clock's output is 40 MHz.

The exemplary speaker unit's audio processor 108 depacketizes and demultiplexes the audio data in the transport signal and outputs audio data 116, preferably $I^2S$ data. Each speaker unit has a unique access control address, similar in function to the media access control (MAC) address assigned to a network adapter, and a hardware type which are hard-wired into the controller 112 at the time of manufacture and which determine the channels of the audio data 116 to be output to the speaker by the audio processor. $I^2S$ audio data 116 output by the audio processor is, preferably, input to a parallel bridge tied load (PBTL) speaker drive 118 connected to a speaker 120. The speaker drive 118 comprises plural pulse width modulators 122, 124 that convert the digital $I^2S$ data 116 from the audio processor 108 to a high frequency succession of pulses 125 which are transmitted to and control the operation of plural H-bridge amplifiers 126 connected to drive the speaker 120.

The $I^2S$ data 116 is transmitted from the speaker unit's audio processor 108 to a first interpolator 130 which is arranged to receive a timing signal from a phase locked loop (PLL) 132 and which increases the sampling frequency of or upsamples the $I^2S$ data by interpolating new samples between each pair of original samples of the data and filtering the resulting data stream with a linear-phase or finite-impulse-response (FIR) filter. Preferably, the first interpolator 130 of the exemplary home theater system has an interpolator ratio of eight, interpolating seven samples between each of the original sample data pairs of the $I^2S$ data.

High quality audio reproduction requires a precise timing signal having minimal jitter. Since each of the multiple remote speaker units of a surround sound system must have its own precision oscillator, the cost of a home theater system can be substantially impacted by the cost of providing an oscillator in each speaker unit. The inventor realized that the radio transceiver in the wireless speaker unit also requires a precise clock signal with minimal jitter and concluded that the radio transceiver's 40 MHz oscillator 114 could provide a base signal having the precision required for high quality audio reproduction. In the speaker unit 100, the radio transceiver's oscillator 114 is connected to a phase locked loop (PLL) 132 which outputs a high frequency signal 134, preferably an 80 MHz signal, to the interpolator and a higher frequency signal 136, preferably a 640 MHz signal. In the PLL, a reference or base signal, the 40 MHz signal of the transceiver oscillator is input to an error detector comprising a phase detector and a charge pump. The output of the error detector is input to a loop filter and then to a voltage controlled oscillator (VCO). A portion of the VCO's output is fed to a frequency divider and back to the phase detector. The error detector compares the signal that is fed back with the reference signal and when the two signal inputs are equal in phase and frequency, the error will be constant and the loop will be "locked."

The upsampled audio data stream is input to a second interpolator 138 which further increases the sampling rate by a second interpolator ratio, for example, a second interpolator ratio of 128; filters the upsampled data and reclocks the upsampled data stream using the incoming data stream from the first interpolator as a template together with the high frequency timing signal 134 from the PLL to generate a new less degraded data stream with the same characteristic as the incoming signal. In addition to phase linearity, oversampling reduces the quantization noise over the audio bandwidth by spreading the constant amount of quantization noise over a wider range of frequencies enabling elimination of quantization noise above the audio frequency range by subsequent low pass filtering.

Figure 4:
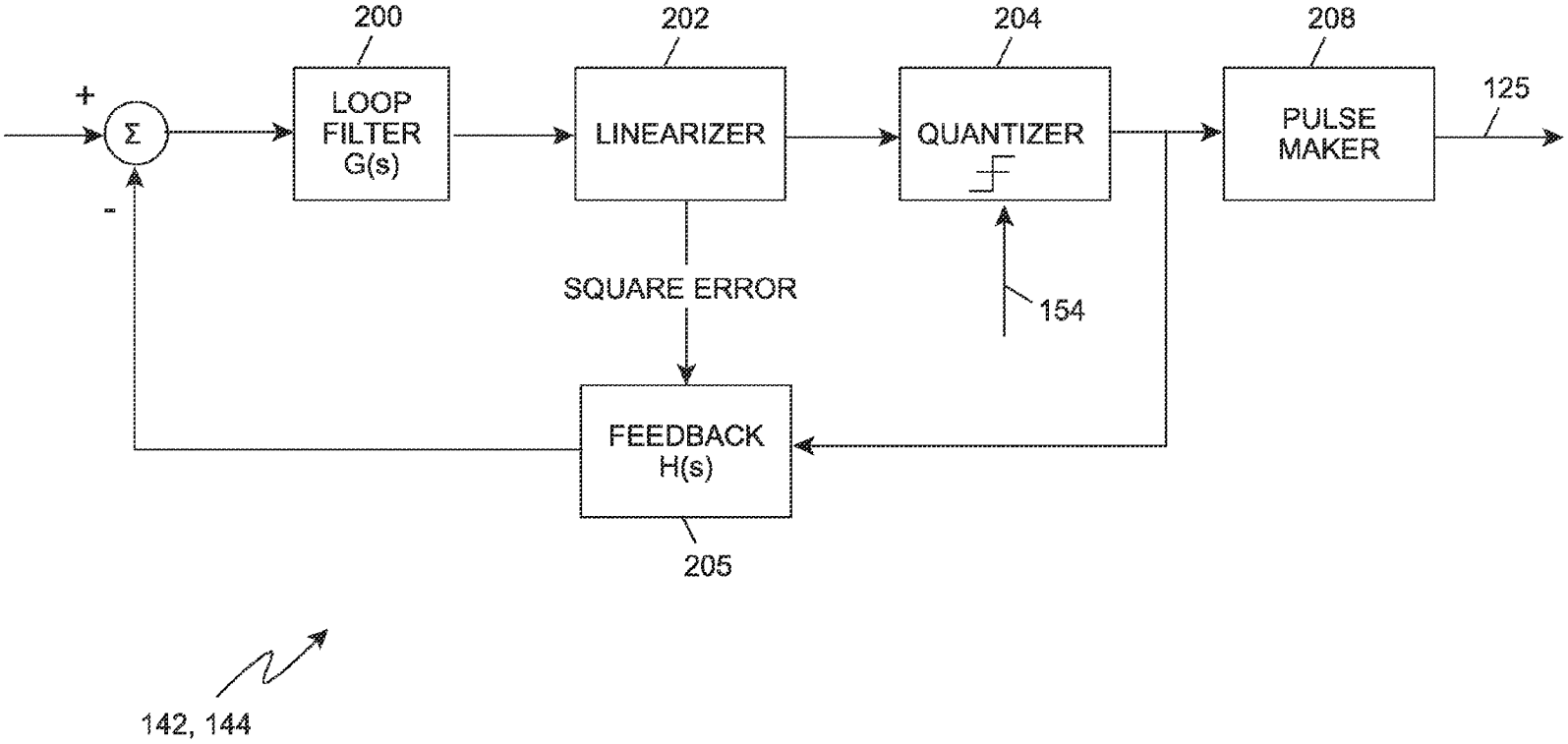
FIG. 4 is a block diagram of a delta-sigma modulator of the exemplary speaker unit of FIG. 3.

A pulse code modulated (PCM) data stream 140 from the second interpolator is input respectively to a first delta-sigma modulator 142 and, following negation 146, input to a second delta-sigma modulator 144 in parallel with the first delta-sigma modulator. Referring also to FIG. 4, in the delta-sigma modulators 142 and 144, the high frequency quantization noise is filtered out by a low-pass filter 200. Predistortion is applied in a linearizer 202 to reduce the distortion at the output and the signal is quantized 204. Requantization error is fed back to the input of each delta-sigma modulator in a feedback loop. The output of the quantizer 204 is input to a high pass lead-lag compensator filter 205 in the feedback loop where the predistortion added by linearizer 202 is reversed. The requantization error is shifted to a higher-frequency range so that it can be filtered out by the low pass loop filter 200.

A delta-sigma modulator can produce "idle" tones when no input is applied degrading the quality of the audio output by the speaker. The inventor realized that a seventh order loop filter 200 applying a seventh order Butterworth polynomial in the denominator and a sixth order Butterworth polynomial in the numerator can provide a stable feedback loop with lower group delay eliminating the idle tone. The loop filter 200 is a lowpass Butterworth filter configuration having a plot of the denominator roots lying in a circle with a radius equal to the corner frequency of the poles (Wc) and numerator roots lying in a circle with a radius equal to the corner frequency of the zeroes (Wz) where Wc is less than Wz.

Digital audio is captured at a number of sampling rates. For examples, broadcast audio and the audio output of sound cards may sampled at either 44.1 kHz or 48 kHz; DVD audio may sampled at 88.2 kHz, 96 kHz, 176.4 kHz or 192 kHz; and the sampling rate of the digital signal from a BD player may be 48 kHz, 96 kHz or 196 kHz. The noise shaping of the delta-sigma modulators 142, 144 is performed on the output of the interpolator 138 which upsamples the signal at a fixed ratio. The inventor realized that the quality of the audio reproduction would be improved if the noise shaping of the delta-sigma modulators was adjusted to account for the different possible sampling rates of the audio data input to the first interpolator. The exemplary speaker unit 100 comprises a sample rate controller 148 which is in communication with the audio processor 108 and the quantizers 204 of the delta-sigma modulators 142, 144. The sampling rate for the audio data 116 is commonly included as metadata in the transport data stream and the audio processor outputs the sampling rate for the $I^2S$ data to the sample rate controller 148 which looks up and adjusts the frequency of an oversampling signal 154 for the sampling rate of the audio data. The frequency of the oversampling signal 154, preferably adjustable between 384 kHz and 768 kHz, controls the quantization rate of the quantizers 204 and, thereby, the pulse rate of the output from the delta sigma modulators 142, 144.

The output of the delta-sigma modulator's quantizer 142, 144 is input to a pulse maker 208, a counter, which outputs a stream of high frequency pulses 125, preferably approximately a 640 MHz pulse width modulated signal. Pulses output by the first delta-sigma modulator 142 and the "negative" pulses (npulses) output by the second delta-sigma modulator 144 are transmitted to the gates of transistors of respective half-bridges 150, 152 of an H-bridge amplifier 126. Likewise the pulses and the npulses output by the delta-sigma modulators of the second pulse width modulator 124 are input to respective gates of transistors of the half-bridges 150, 152 of a second H-bridge amplifier 126. The pulses from the pulse maker 208 control the source to drain conduction of the transistors of the half bridges which are connected to drive the speaker 120. To prevent the transistors 151 of both of the half-bridges 150, 152 of a respective H-bridge amplifier from conducting at the same time, each delta-sigma modulator is adjustable to create a dead time between pulses and npulses in which the transistors of neither of the half-bridges are driven. The cost of the speaker units can be further reduced because with the exception of the speaker and the H-bridge amplifiers which may be tailored for the requirements of the different speaker types, e.g. woofer, midrange or tweeter, the electronic circuitry of the speaker unit can be standardized.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. A wireless speaker unit for an audio system comprising:

(a) a transceiver arranged to receive a transmitted radio frequency signal and to separate from said transmitted radio frequency signal plural audio data samples each audio data sample preceding another audio data sample at a first audio data sampling rate, said transceiver including a transceiver oscillator arranged to output an alternating transceiver oscillator signal;

(b) a pulse width modulator arranged to convert said plural data samples to a succession of pulses proceeding at a pulse rate adjusted for said first audio data sampling rate; and (c) a speaker operable by said pulses of increased magnitude to emit sound.

2. The wireless speaker unit of claim 1 further comprising a sample rate controller arranged to determine said first audio data sampling rate and to input a first oversampling signal to said pulse width modulator, said first oversampling signal one of plural first oversampling signals each having a frequency and each corresponding to a respective one of plural audio data sampling rates, said pulse width modulator responsive to said frequency of said first oversampling signal to output pulses at said pulse rate.

3. The wireless speaker unit of claim 1 wherein said pulse width modulator comprises a seventh order loop filter.

4. The wireless speaker unit of claim 1 further comprising:

(a) a phase lock loop arranged to receive said transceiver oscillator signal and to output a second oversampling signal and a third oversampling signal to said pulse width modulator, said second oversampling signal a multiple of said transceiver oscillator signal and said third oversampling signal a multiple of said transceiver oscillator signal and said second oversampling signal; and (b) a first interpolator responsive to said second oversampling signal to insert plural first interpolated audio data between a first audio sample and a succeeding audio sample.

5. The wireless speaker unit of claim 4 further comprising a sample rate controller arranged to determine said first audio data sampling rate and to input a first oversampling signal to said pulse width modulator, said first oversampling signal one of plural first oversampling signals each having a frequency and each corresponding to a respective one of plural audio data sampling rates, said pulse width modulator responsive to said frequency of said first oversampling signal to output pulses at said pulse rate.

6. The wireless speaker unit of claim 4 further comprising a second interpolator responsive to said second oversampling signal to insert plural second interpolated audio data between said first audio sample and an immediately succeeding first interpolator datum.

7. The wireless speaker unit of claim 6 further comprising a sample rate controller arranged to determine said first audio data sampling rate and to input a first oversampling signal to said pulse width modulator, said first oversampling signal one of plural first oversampling signals each having a frequency and each corresponding to a respective one of plural audio data sampling rates, said pulse width modulator responsive to said frequency of said first oversampling signal to output pulses at said pulse rate.

8. The wireless speaker unit of claim 7 wherein said pulse width modulator comprises a seventh order loop filter.

9. A pulse width modulator for converting audio data to a succession of pulses, said audio data comprising plural audio samples, a second audio sample succeeding a first audio sample at an audio sampling rate, said pulse width modulator comprising;

(a) a first interpolator inserting at least one first interpolated audio datum between said first audio sample and said second audio sample;

(b) a second interpolator inserting at least one second interpolated audio datum between said first audio sample and said first interpolated audio datum; and (c) a delta sigma modulator arranged to convert an output of said second interpolator to a succession of pulses, said delta sigma modulator comprising a quantizer responsive to a frequency of an oversampling signal to vary a quantization rate, said frequency of said oversampling signal responsive to said audio sampling rate.

10. The pulse width modulator of claim 9 wherein said delta sigma modulator further comprises a seventh order loop filter.

11. The pulse width modulator of claim 10 wherein said seventh order loop filter is a Butterworth filter.

12. A wireless audio speaker unit comprising:

(a) a transceiver arranged to receive a transmitted radio frequency signal and to separate from said transmitted radio frequency signal plural audio data samples each audio data sample preceding another audio data sample at an audio data sampling rate, said transceiver including a transceiver oscillator arranged to output a transceiver oscillator signal alternating at a transceiver oscillator frequency;

(b) a phase lock loop communicatively connected to said transceiver oscillator and arranged to output an interpolator signal, said interpolator signal a multiple of said transceiver oscillator frequency;

(c) a first interpolator responsive to said interpolator signal to insert plural first interpolated audio data between a first audio sample and a second audio sample;

(d) a second interpolator communicatively connected to said first interpolator and responsive to said interpolator signal, said second interpolator inserting plural second interpolated audio data between said first audio sample and a first interpolated audio datum;

(e) a delta sigma modulator arranged to convert said audio samples, said first interpolated audio data and said second interpolated audio data to a succession of pulses at a rate adjusted for said audio sample rate; and (f) a speaker responsive to said succession of pulses to emit sound.

13. The wireless speaker unit of claim 12 further comprising a sample rate controller communicatively connected to said transceiver oscillator, said sample rate controller arranged to determine said audio data sampling rate and to input an oversampling signal to said delta sigma modulator, said oversampling signal one of plural oversampling signals each having a respective frequency and each corresponding to a respective one of plural audio data sampling rates, said delta sigma modulator responsive to said frequency of said oversampling signal to adjust said rate of said pulses.

14. The wireless speaker unit of claim 13 wherein said delta sigma modulator further comprises a seventh order loop filter.

15. The wireless speaker unit of claim 14 wherein said seventh order loop filter is a Butterworth filter.

* * * * *